US010234227B2

(12) United States Patent
Hayes et al.

(10) Patent No.: US 10,234,227 B2
(45) **Date of Patent: *Mar. 19, 2019**

(54) CONVERSION DEVICE FOR A FIREARM

(71) Applicant: Outlander, LLC, Eagle, ID (US)

(72) Inventors: Steve Hayes, Eagle, ID (US); Roy Chester, Eagle, ID (US)

(73) Assignee: Outlander, LLC, Eagel, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/850,941

(22) Filed: Dec. 21, 2017

(65) Prior Publication Data

US 2018/0209756 A1 Jul. 26, 2018

Related U.S. Application Data

(63) Continuation of application No. 15/001,059, filed on Jan. 19, 2016, now Pat. No. 9,857,136.

(60) Provisional application No. 62/105,137, filed on Jan. 19, 2015.

(51) Int. Cl.

| | |
|---|---|
| ***F41A 11/02*** | (2006.01) |
| ***F41A 21/10*** | (2006.01) |
| ***F41A 3/12*** | (2006.01) |
| ***F41A 11/00*** | (2006.01) |

(52) U.S. Cl.
CPC ..... *F41A 21/10* (2013.01); *F41A 3/12* (2013.01); *F41A 11/00* (2013.01)

(58) Field of Classification Search
CPC ..... F41A 21/10; F41A 21/482; F41A 3/78; F41A 11/02; F41A 9/71; F41C 23/16; F41G 11/003
USPC ..... 42/76.01, 77, 49.02; 89/29
See application file for complete search history.

(56) References Cited

U.S. PATENT DOCUMENTS

| | | | | |
|---|---|---|---|---|
| 3,226,869 | A | 1/1966 | Musgrave | |
| 4,142,314 | A | 3/1979 | Foote | |
| 4,169,329 | A | 10/1979 | Atchisson | |
| 4,194,314 | A | 3/1980 | Foote | |
| 4,297,800 | A | 11/1981 | Atchisson | |
| 4,589,218 | A | 5/1986 | Teppa | |
| 8,141,287 | B2 | 3/2012 | Dubois | |
| 2010/0126053 | A1 | 5/2010 | Fitzpatrick et al. | |
| 2010/0162604 | A1 | 7/2010 | Dubois | |
| 2010/0269389 | A1 | 10/2010 | Lopez Laparra | |
| 2011/0173857 | A1 | 7/2011 | Hogan, Jr. | |
| 2012/0131831 | A1 | 5/2012 | Sullivan et al. | |
| 2012/0144712 | A1 | 6/2012 | Rostocil | |
| 2013/0247437 | A1 | 9/2013 | Obermeit | |
| 2016/0245608 | A1* | 8/2016 | Hayes | F41A 21/10 |

* cited by examiner

*Primary Examiner* — Michael D David
(74) *Attorney, Agent, or Firm* — Banner & Witcoff, Ltd.

(57) ABSTRACT

A conversion device for converting a firearm designed to fire a cartridge of a certain size and caliber to another size and caliber cartridge is disclosed. In some embodiments, the conversion device is suitable for converting an AR-15 type firearm to be able to fire .22 caliber cartridges. Disclosed embodiments of the conversion device may comprise an appropriately sized chamber insert to fit in the chamber of the firearm, a bolt, an extractor, extractor plunger, extractor spring, firing pins, firing pin springs, a bolt spring rod and block, a bolt return spring, slide rails, lock rings, and lock pins.

16 Claims, 6 Drawing Sheets

CONVERSION DEVICE FOR A FIREARM

CROSS-REFERENCE TO RELATED APPLICATIONS

This application is a continuation of U.S. patent application Ser. No. 15/001,059, filed Jan. 19, 2016, now U.S. Pat. No. 9,857,136, which claims priority to U.S. Provisional Application No. 62/105,137, filed Jan. 19, 2015, which are expressly incorporated herein by reference in their entireties for any and all non-limiting purposes.

FIELD OF DISCLOSURE

The disclosure relates generally to firearms, and more particularly to a conversion device to allow the firearm to accept ammunition of differing sizes and calibers.

BACKGROUND

Firearms are typically designed to accept and fire ammunition of a particular size and caliber. For example, an AR-15 rifle may be designed to fire a .223 Remington caliber cartridge or a 5.56.times.45 mm NATO cartridge. However, when shooting a significant number of rounds, it may be desirable to use a less expensive type of ammunition, such as a .22 caliber cartridge. Typically, a .22 caliber cartridge will not fit into the magazine and firing action of the firearm designed to fire another size and caliber cartridge. In addition a .22 cartridge is a rimfire cartridge and a 5.56.times.45 mm NATO cartridge is a centerfire cartridge which require different firing actions. Therefore, a conversion device to allow a firearm to shoot another size, type, and caliber cartridge is desirable.

In addition, in existing systems, conversion devices include slide rail legs, or the equivalent, often flex away from a chamber insert during use which can open up the tolerances between the bolt and the slide rail and allow the bolt to move off center in the firearm. Other drawbacks of existing systems also exist.

SUMMARY

Accordingly, a conversion device for converting a firearm designed to fire a cartridge of a certain size and caliber to another size and caliber cartridge is disclosed. In some embodiments, the conversion device is suitable for converting an AR-15 type firearm to be able to fire .22 caliber cartridges. As used herein .22 caliber cartridges includes, but is not limited to, .22 caliber long rifle cartridges. Furthermore, the disclosed system is applicable to any suitable firearm that utilizes a .223 Remington caliber cartridge or a 5.56×45 mm NATO cartridge to utilize or fire a .22 caliber long rifle cartridge such as, for example, an AR-15, M4, M-16, or the like. Other advantages and features of the disclosed conversion device also exist.

Disclosed embodiments include a conversion device comprising a chamber insert, a bolt, a slide rail coupling the chamber insert and the bolt, a buffer, and a spring that biases the slide rail and the buffer apart. Further disclosed embodiments comprise a bolt rod block that couples with the bolt. In further embodiments the bolt rod block is interchangeable with another bolt rod block of different weight.

In still further embodiments the conversion device comprises a bolt spring rod interfaces with the bolt rod block at one end and the buffer at the other end, and a bolt return spring mounted on the bolt spring rod. In further embodiments a clip attaches to the bolt rod and holds the bolt return spring in position.

In still further embodiments, the conversion device comprises a slide rail lock ring that mounts over a front portion of the slide rail and secures the chamber insert to the bolt.

In still further embodiments, the conversion device further comprises an enlarged ramp in a cartridge receiving portion of the chamber insert and side ears on a pick up tang portion of the bolt. In further embodiments, the enlarged ramp comprises a recess in the enlarged ramp to accommodate the side ears.

Figure 1:
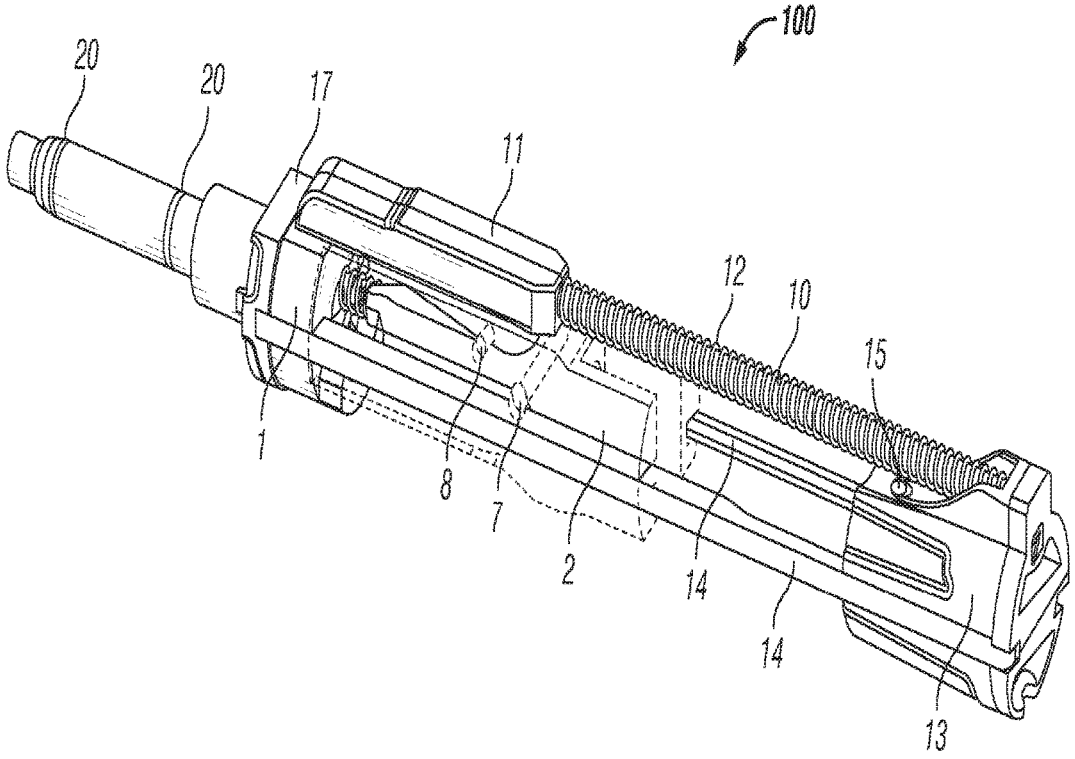
FIG. 1 is a perspective view of the conversion device in accordance with some disclosed embodiments.
Figure 2:
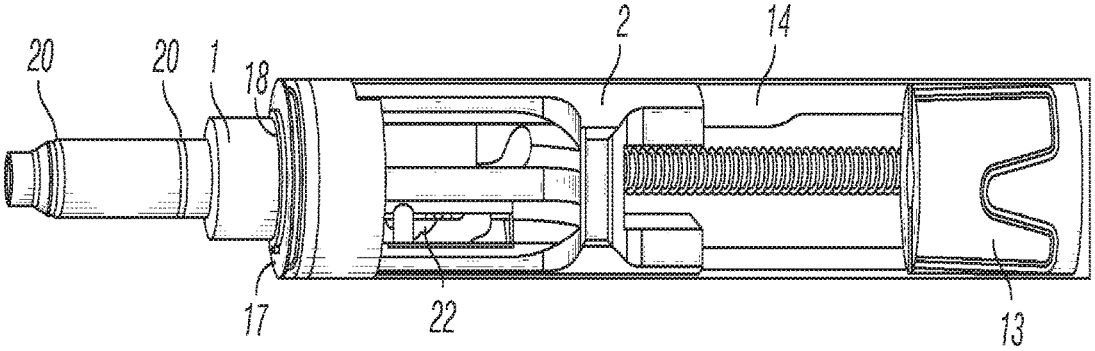
FIG. 2 is a bottom view of the conversion device in accordance with some disclosed embodiments.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

As shown in the figures, embodiments of the conversion device may enable a firearm, such as an AR-15 type firearm to fire a different size and caliber cartridge than the originally manufactured size. In some embodiments, the conversion device enables the AR-15 type firearm to fire .22 caliber cartridges.

As shown, embodiments of the conversion device 100 may comprise an appropriately sized chamber insert 1 to fit in the chamber of the firearm, a bolt 2, an extractor 4, extractor plunger 3, extractor spring 5, firing pins 6, firing pin springs 9, a bolt spring rod 10 and block 11, a bolt return spring 12, slide rails 14, lock rings 17, lock pins 15, and the like.

In addition, embodiments of the conversion device 100 may comprise a slide rail retaining ring 18. In addition, embodiments may comprise a bolt rod block 11 that may be interchangeable to, among other things, enable fine tuning of the firearm bolt action. Embodiments may also comprise a buffer spring 16 that may be loaded in order to preload the conversion device 100 into the chamber of the firearm barrel. Embodiments may also comprise a bolt underside 22 that is shaped and dimensioned to accommodate wider feed lips on a cartridge magazine such as the one disclosed in co-pending application Ser. No. 14/490,945, filed Sep. 19, 2014, titled "Dual Stack Magazine," and the contents of which are hereby incorporated by reference herein.

FIG. 1 is a perspective view of the conversion device 100 in accordance with some disclosed embodiments. As shown a chamber insert 1 is sized to fit into the appropriate firearm chamber (not shown). For example, chamber insert 1 may be sized to fit into the chamber of an AR-15 firearm if the conversion device 100 is to be used with an AR-15 firearm. One or more O-rings 20 may also be included to ensure an appropriate fit in the chamber. Of course, other sizes and firearms are possible.

Figure 6:
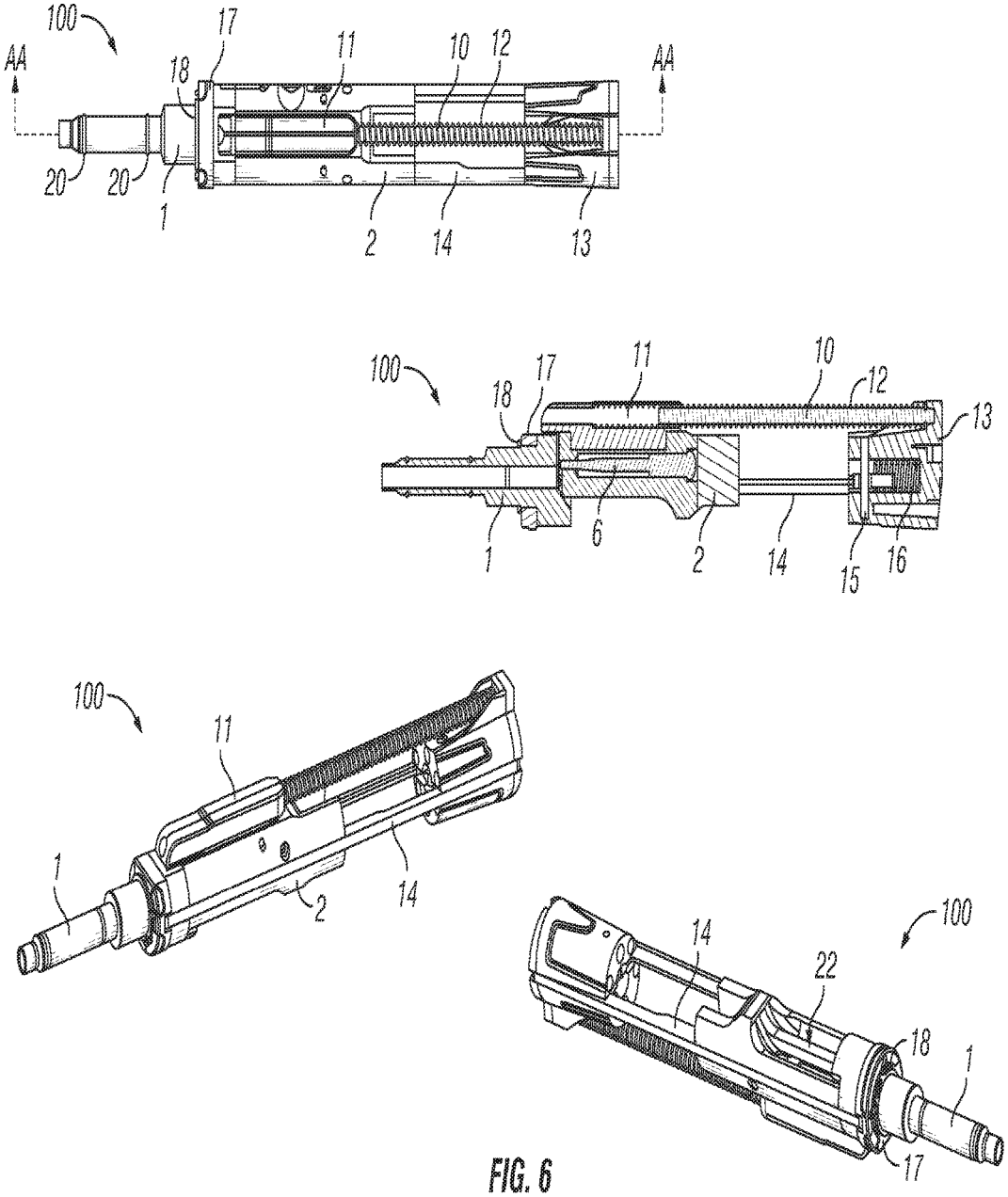
FIG. 6 is a multi-view of the conversion device in accordance with some disclosed embodiments.

Chamber insert 1 mates with bolt 2 (shown in phantom in FIG. 1). As best seen in FIG. 6, firing pin 6 is housed within bolt 2 and is appropriately offset in order to strike the rim or a cartridge (not shown) in order to accommodate the .22 caliber cartridges which are typically rimfire cartridges.

Chamber insert 1 and bolt 2 may be held together by slide rail 14 in cooperation with slide rail lock ring 17 and retaining ring 18. Other designs for holding chamber insert 1 and bolt 2 together may also be used. For example, a threaded engagement portion, or the like, could be implemented between chamber insert 1 and bolt 2.

As shown bolt 2 may also comprise a firing pin roll pin 7 and a buffer rod block roll pin 8. Bolt rod block 11 may be held in bolt 2 via buffer rod block roll pin 8. Bolt rod block 11 is designed to be interchangeable with other bolt rod blocks 11, each of a different weight. In such a manner, a shooter may use a heavier or lighter version of bolt rod block 11 in order to fine tune the function of the bolt system in accordance with the shooter's preferred response. In addition, bolt rod block 11 serves as an interface point for bolt spring 12 and bolt spring rod 10.

Figure 3:
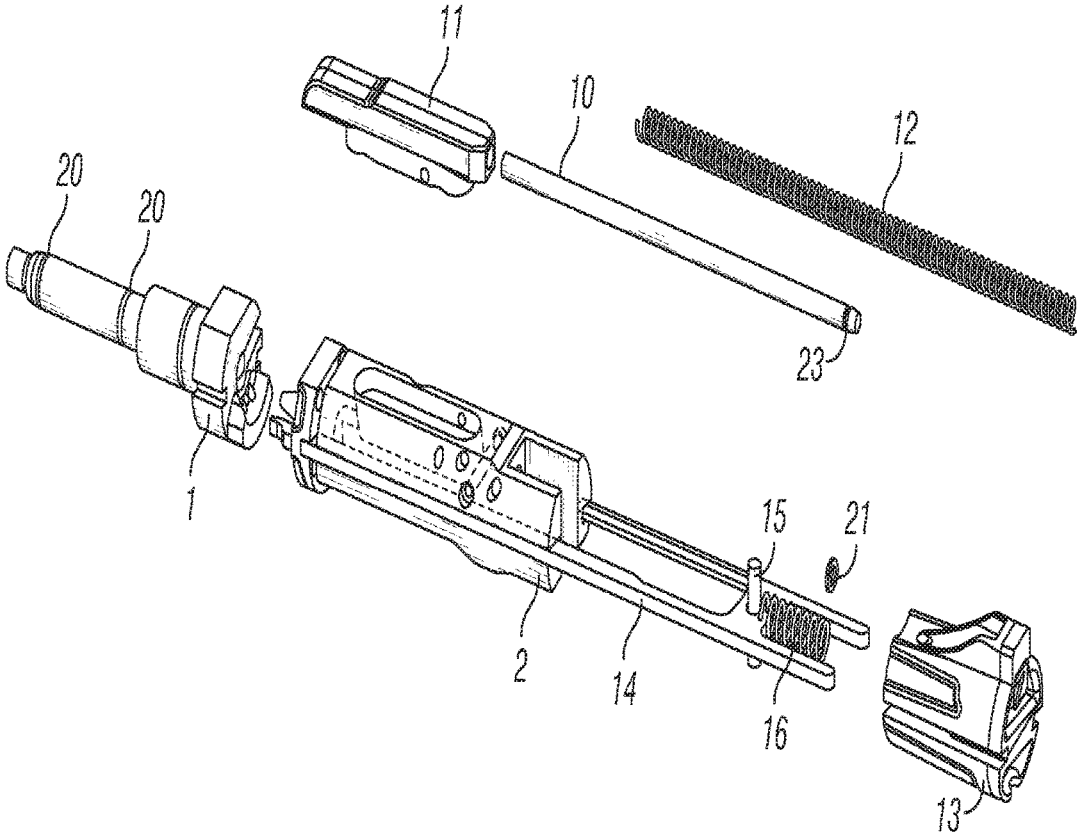
FIG. 3 is an exploded perspective view of the conversion device in accordance with some disclosed embodiments.
Figure 4:
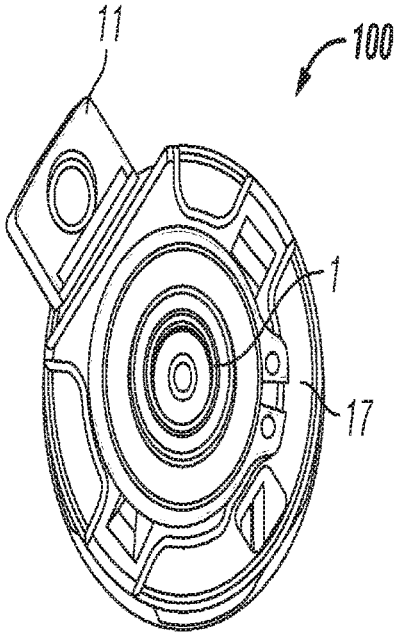
FIG. 4 is a front view of the conversion device in accordance with some disclosed embodiments.
Figure 5:
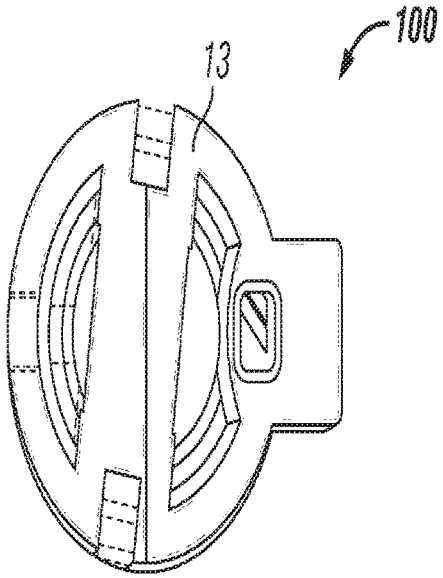
FIG. 5 is a rear view of the conversion device in accordance with some disclosed embodiments.
Figure 7:
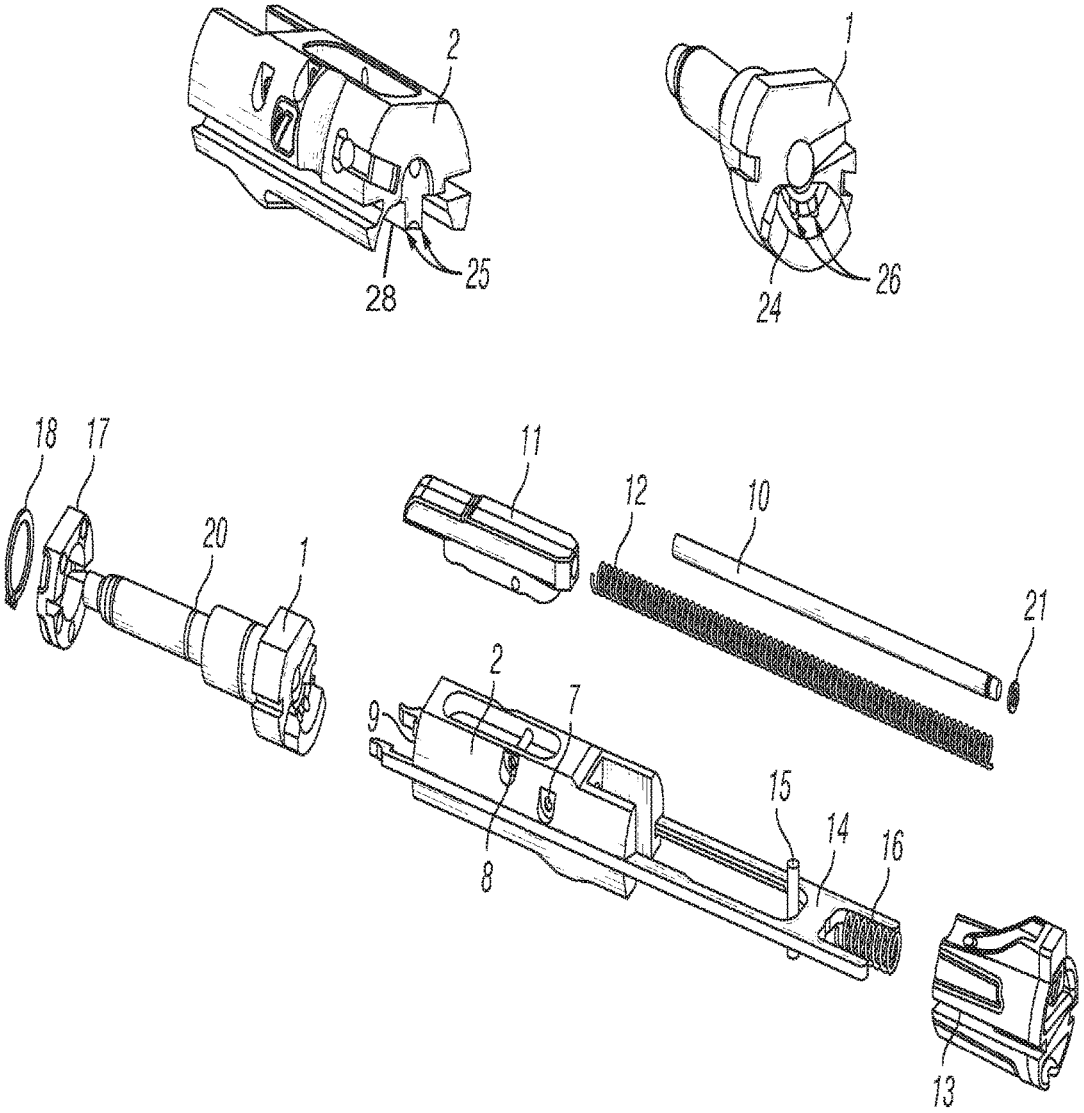
FIG. 7 is an exploded view of the conversion device in accordance with some disclosed embodiments.

As shown the other end of bolt spring 12 and bolt spring rod 10 interfaces with buffer 13. As best seen in FIG. 3, 6, or 7, buffer spring 16 biases buffer 13 and slide rail 14 apart. This, in turn, pushes buffer 13 against the lower receiver of the firearm (not shown) and consequently pushes the entire assembly (via slide rails 14, slide rail lock ring 17, and retaining ring 18) forward into the chamber (not shown). Such biasing gives a tight and secure fit of the chamber insert 1 into the chamber of the firearm during firing.

As also shown in FIG. 3, 6, or 7, conversion device 100 may also comprise a buffer lock pin 15 to assist with the biasing. In addition, embodiments may comprise a clip 21 that engages a recess 23, or the like, in bolt spring rod 10 to secure bolt return spring 12. Other retaining methods may also be used. Use of the clip 21, among other things, simplifies assembly and disassembly of the bolt spring rod 10 and bolt return spring 12.

In some embodiments, slide rail lock ring 17 may be slid into place over the front prongs of slide rail 14 after slide rail 14 has been installed on chamber insert 1. Among other things, this captures the chamber insert 1 into the slide rail 14. The slide rail lock ring 17 also keeps the slide rail 14 legs clamped tight against the sides of the chamber insert 1 which helps maintain the functional working tolerance space between the slide rail 14 and the bolt 2.

As shown in FIG. 7, chamber insert 1 may also comprise a relatively large ramp area 24 that has been optimized to help guide cartridges into the chamber insert 1. Ramp area 24 may also comprise recessed areas 26 that accommodate side ears 25 on the pick up tang 28 of the bolt 2. The side ears 25 assist in picking up a cartridge out of the magazine (not shown) and compensate for the off-center location of the cartridges.

Although various embodiments have been shown and described, the present disclosure is not so limited and will be understood to include all such modifications and variations are would be apparent to one skilled in the art.

We claim:

1. A conversion device for a firearm comprising: a chamber insert;

a bolt;

a slide rail comprising a chamber end and a buffer end, the slide rail coupling the chamber insert and the bolt at the chamber end of the slide rail;

a slide rail lock ring that mounts over the chamber end of the slide rail and secures the chamber insert to the slide rail;

a buffer coupled to the slide rail at the buffer end; and a buffer spring located at the buffer end of the slide rail and in contact with the slide rail and the buffer, and wherein the buffer spring biases the slide rail and the buffer apart.

2. The conversion device of claim 1 further comprising: a bolt rod block that couples to the bolt, and a bolt spring rod that interfaces with the bolt rod block at one end of the rod and interfaces with the buffer at the other end of the rod, a bolt return spring mounted around the bolt spring rod.

3. The conversion device of claim 2 further comprising a clip that attaches to the bolt spring rod and holds the bolt return spring in position.

4. The conversion device of claim 1 wherein the slide rail lock ring defines a first side that mates with the chamber insert and further defines an engagement portion to engage with the slide rail.

5. The conversion device of claim 1 further comprising an enlarged ramp in a cartridge receiving portion of the chamber insert.

6. The conversion device of claim 1 further comprising side ears on a pick up tang portion of the bolt.

7. The conversion device of claim 6 further comprising an enlarged ramp in a cartridge receiving portion of the chamber insert; and a recess in the enlarged ramp to accommodate the side ears.

8. The conversion device of claim 2, further comprising a firing pin that is housed within the bolt and is offset from a longitudinal center of the bolt.

9. A firearm that incorporates the conversion device of claim 1.

10. A conversion device for a firearm comprising: a chamber insert;

a bolt;

a slide rail comprising a chamber end and a buffer end, the slide rail coupled to the chamber insert and the bolt at the front end, the slide rail defining prongs;

a slide rail lock ring that mounts over the prongs of the slide rail and secures the chamber insert to the slide rail; and a buffer coupled to the slide rail at the buffer end, and a buffer spring in contact with the slide rail and the buffer, wherein the buffer spring biases the slide rail and the buffer apart.

11. The conversion device of claim 10 further comprising: a bolt rod block that couples to the bolt, and a bolt spring rod that interfaces with the bolt rod block at one end of the rod and interfaces with the buffer at the other end of the rod, a bolt return spring mounted around the bolt spring rod.

12. The conversion device of claim 10 wherein the slide rail lock ring defines a first side that mates with the chamber insert and further defines an engagement portion to engage with the slide rail.

13. The conversion device of claim 12 further comprising side ears on a pick up tang portion of the bolt.

14. The conversion device of claim 13 further comprising:

an enlarged ramp in a cartridge receiving portion of the chamber insert; and a recess in the enlarged ramp to accommodate the side ears.

15. The conversion device of claim 10, further comprising a firing pin that is housed within the bolt and is offset from a longitudinal center of the bolt.

16. A firearm that incorporates the conversion device of claim 10.

* * * * *